US008677533B2

(12) United States Patent
Barron et al.

(10) Patent No.: US 8,677,533 B2
(45) Date of Patent: Mar. 25, 2014

(54) CHILD SEAT INSERTS AND METHODS OF MANUFACTURE

(75) Inventors: Traci J. Barron, Saint John, IN (US); Scott A. Walterman, Milwaukee, WI (US)

(73) Assignee: Kolcraft Enterprises, Inc., Chicago, IL (US)

( * ) Notice: Subject to any disclaimer, the term of this patent is extended or adjusted under 35 U.S.C. 154(b) by 25 days.

(21) Appl. No.: 13/279,223

(22) Filed: Oct. 21, 2011

(65) Prior Publication Data

US 2012/0096646 A1 Apr. 26, 2012

Related U.S. Application Data

(60) Provisional application No. 61/405,527, filed on Oct. 21, 2010.

(51) Int. Cl.
*A47C 16/00* (2006.01)

(52) U.S. Cl.
USPC ..... 5/655; 5/93.1; 5/98.1

(58) Field of Classification Search
USPC ..... 5/655, 93.1, 98.1, 98.3; 297/219.1, 297/219.12, 440.11, 250.1, 256.16, 354.13
See application file for complete search history.

(56) References Cited

U.S. PATENT DOCUMENTS

| | | | | |
|---|---|---|---|---|
| 1,204,416 | A | | 11/1916 | Doser |
| 2,277,406 | A | | 3/1942 | Mahr |
| 2,467,890 | A | | 4/1949 | Harvey |
| 2,488,225 | A | | 11/1949 | Mover |
| 2,990,007 | A | | 6/1961 | Kessler |
| 3,146,028 | A | | 8/1964 | Grosfillex |
| 3,311,934 | A | | 4/1967 | Goldberg |
| 4,426,113 | A | * | 1/1984 | Schutz ..... 297/440.11 |
| 5,096,260 | A | | 3/1992 | Hagerstrom |
| 5,161,273 | A | | 11/1992 | Deck |
| D340,140 | S | | 10/1993 | Cunningham et al. |
| 5,269,587 | A | | 12/1993 | Cunningham et al. |

(Continued)

FOREIGN PATENT DOCUMENTS

| | | | |
|---|---|---|---|
| CN | 2190912 | Y | 3/1995 |
| CN | 1274559 | A | 11/2000 |
| CN | 101297726 | A | 11/2008 |

OTHER PUBLICATIONS

United States Patent and Trademark Office, "Non-Final Office," issued in connection with U.S. Appl. No. 12/769,417, Jun. 19, 2013, 38 pages.

(Continued)

*Primary Examiner* — Robert G Santos
*Assistant Examiner* — Richard G Davis
(74) *Attorney, Agent, or Firm* — Hanley, Flight & Zimmerman, LLC

(57) ABSTRACT

Seat inserts and methods of manufacturing seat inserts are disclosed. An example seat insert includes a frame. A first base panel is coupled to the frame, and a second base panel is coupled to the frame. The second base panel is joined to the first base panel. The first base panel is positioned at a first incline and the second base panel is positioned at a second incline to provide an inclined support for a child. A relative length of at least one of the first base panel or the second base panel is adjustable to adjust angles of inclination of the first base panel and the second base panel.

22 Claims, 10 Drawing Sheets

(56) References Cited

U.S. PATENT DOCUMENTS

| | | | | |
|---|---|---|---|---|
| D347,328 | S | 5/1994 | Efthimiou | |
| 5,339,470 | A | 8/1994 | Shamie | |
| D353,493 | S | 12/1994 | Schwartzkopf et al. | |
| 5,409,411 | A * | 4/1995 | Schrieber | 441/80 |
| 5,553,336 | A | 9/1996 | Mariol | |
| 5,778,465 | A | 7/1998 | Myers | |
| 5,845,349 | A | 12/1998 | Tharalson et al. | |
| 5,867,850 | A | 2/1999 | Mariol | |
| 5,991,944 | A | 11/1999 | Yang | |
| 6,026,525 | A | 2/2000 | Davis | |
| 6,058,528 | A | 5/2000 | Yang | |
| 6,192,535 | B1 | 2/2001 | Warner, Jr. et al. | |
| 6,233,759 | B1 | 5/2001 | Warner, Jr. et al. | |
| 6,421,856 | B1 | 7/2002 | Furnback | |
| 6,430,762 | B1 | 8/2002 | Cheng | |
| D467,093 | S | 12/2002 | Brophy | |
| 6,526,608 | B1 | 3/2003 | Hsia | |
| 6,539,563 | B1 * | 4/2003 | Hsia | 5/93.2 |
| 6,634,038 | B2 | 10/2003 | Hsia | |
| 6,704,949 | B2 | 3/2004 | Waldman et al. | |
| 6,708,356 | B1 | 3/2004 | LaValle | |
| 6,735,796 | B2 | 5/2004 | Warner, Jr. et al. | |
| 6,848,128 | B2 | 2/2005 | Verbovszky et al. | |
| 6,898,812 | B2 | 5/2005 | Smart | |
| 6,915,536 | B2 | 7/2005 | Chen | |
| 6,961,968 | B2 | 11/2005 | Clapper et al. | |
| 7,003,821 | B2 | 2/2006 | DeHart et al. | |
| 7,017,203 | B2 | 3/2006 | Chen | |
| 7,055,191 | B1 * | 6/2006 | Chen | 5/93.2 |
| 7,059,000 | B2 | 6/2006 | Verbovszky | |
| 7,111,339 | B2 | 9/2006 | Chen | |
| D535,506 | S | 1/2007 | Wilson | |
| 7,228,575 | B2 | 6/2007 | Chen | |
| 7,263,729 | B2 | 9/2007 | Paesang et al. | |
| 7,326,120 | B2 | 2/2008 | Bellows et al. | |
| 7,418,745 | B2 * | 9/2008 | Paesang et al. | 5/98.1 |
| 7,458,114 | B2 | 12/2008 | Troutman | |
| 7,543,342 | B2 | 6/2009 | Zhao et al. | |
| 7,568,242 | B2 | 8/2009 | Troutman | |
| 7,695,374 | B2 | 4/2010 | Bellows et al. | |
| 8,028,358 | B2 * | 10/2011 | Fiore, Jr. | 5/93.2 |
| 8,201,291 | B2 * | 6/2012 | Burns et al. | 5/93.2 |
| 8,424,138 | B1 | 4/2013 | Pinnell | |
| 2002/0092094 | A1 * | 7/2002 | Welsh, Jr. | 5/95 |
| 2003/0046761 | A1 * | 3/2003 | Hsia | 5/99.1 |
| 2003/0070230 | A1 | 4/2003 | Hsia | |
| 2003/0177575 | A1 | 9/2003 | Cheng et al. | |
| 2005/0278857 | A1 | 12/2005 | Fairchild et al. | |
| 2006/0207023 | A1 | 9/2006 | De Hart et al. | |
| 2006/0218725 | A1 | 10/2006 | Carpenter et al. | |
| 2006/0253978 | A1 | 11/2006 | Paesang et al. | |
| 2008/0271243 | A1 | 11/2008 | Burkholder et al. | |
| 2009/0077738 | A1 | 3/2009 | Burns et al. | |
| 2009/0077739 | A1 | 3/2009 | Mendes et al. | |
| 2009/0077740 | A1 | 3/2009 | Jackson et al. | |
| 2010/0255919 | A1 * | 10/2010 | Kelly et al. | 472/118 |
| 2011/0148159 | A1 | 6/2011 | Barron et al. | |
| 2011/0197358 | A1 * | 8/2011 | Bu et al. | 5/93.1 |

OTHER PUBLICATIONS

The State Intellectual Property Office of China, "First Office Action," issued in connection with Application No. 201010599288.0, Sep. 12, 2013, 9 pages.

The State Intellectual Property Office of China, "Search Report," issued in connection with Application No. 201010599288.0, Sep. 12, 2013, 2 pages.

* cited by examiner

CHILD SEAT INSERTS AND METHODS OF MANUFACTURE

RELATED APPLICATIONS

This patent claims the benefit of U.S. Provisional Patent Application Ser. No. 61/405,527, entitled "Child Seat Inserts and Methods of Manufacture," which was filed on Oct. 21, 2010, and is incorporated herein by reference in its entirety.

FIELD OF THE DISCLOSURE

This disclosure relates generally to child care products, and, more particularly, to child seat inserts and methods of manufacturing the same.

BACKGROUND

Stand alone bassinets and bassinets that are coupled to playards are known in the art.

DETAILED DESCRIPTION

Bassinets and playards often include a flat, horizontal sleeping surface for a child. However, it is often desirable for a child to lie in an inclined position. Example seat inserts disclosed herein enable a child occupant to lie in an inclined position, which may ease symptoms of reflux or congestion, and/or may facilitate digestive and/or respiratory functions.

Further, it is often desirable to transport a sleeping child from a playard or bassinet to another location. However, the position of the child typically must be disturbed to remove the child from the horizontal surface of the playard or bassinet. Example seat inserts disclosed herein are lightweight and can be moved while the child remains in the seat insert. As a result, the child can be transported without disturbing the position of the child. Thus, example seat inserts disclosed herein provide a portable sleeping surface for a child.

Further, example seat inserts disclosed herein may be used on a surface outside of a playard or bassinet. Some example seat inserts disclosed herein may be used in a side-by-side relationship with another child care-taking structure such as, for example, a changing table, one or more storage compartments or any other accessory (e.g., an accessory to aid child care functions such as, for example, diaper changing).

Some example seat inserts disclosed herein include a frame. In some such examples, a first base panel is coupled to the frame, and a second base panel is coupled to the frame. The second base panel is joined to the first base panel. The first base panel is positioned at a first incline, and the second base panel is positioned at a second incline to provide an inclined support for a child. A relative length of at least one of the first base panel and the second base panel is adjustable to adjust the angles of inclination of the first base panel and the second base panel.

Some example seat inserts disclosed herein include a frame. In some such examples, a first base panel is coupled to the frame at a first incline, a second base panel is coupled to the frame at a second incline, and a third base panel is joined to at least one of the first base panel or the second base panel. A length of the third base panel being adjustable to adjust one or more of an angle of inclination of the first base panel, an angle of inclination of the second base panel, or an angle of inclination of the third base panel to provide an inclined support for a child occupant.

Example methods of manufacturing a seat insert disclosed herein include coupling a first panel to a second panel to position the first panel at a first incline and the second panel at a second incline to cause a child to assume an inclined position. Some such examples include coupling the first panel to the frame and coupling the second panel to the frame.

Figure 1:
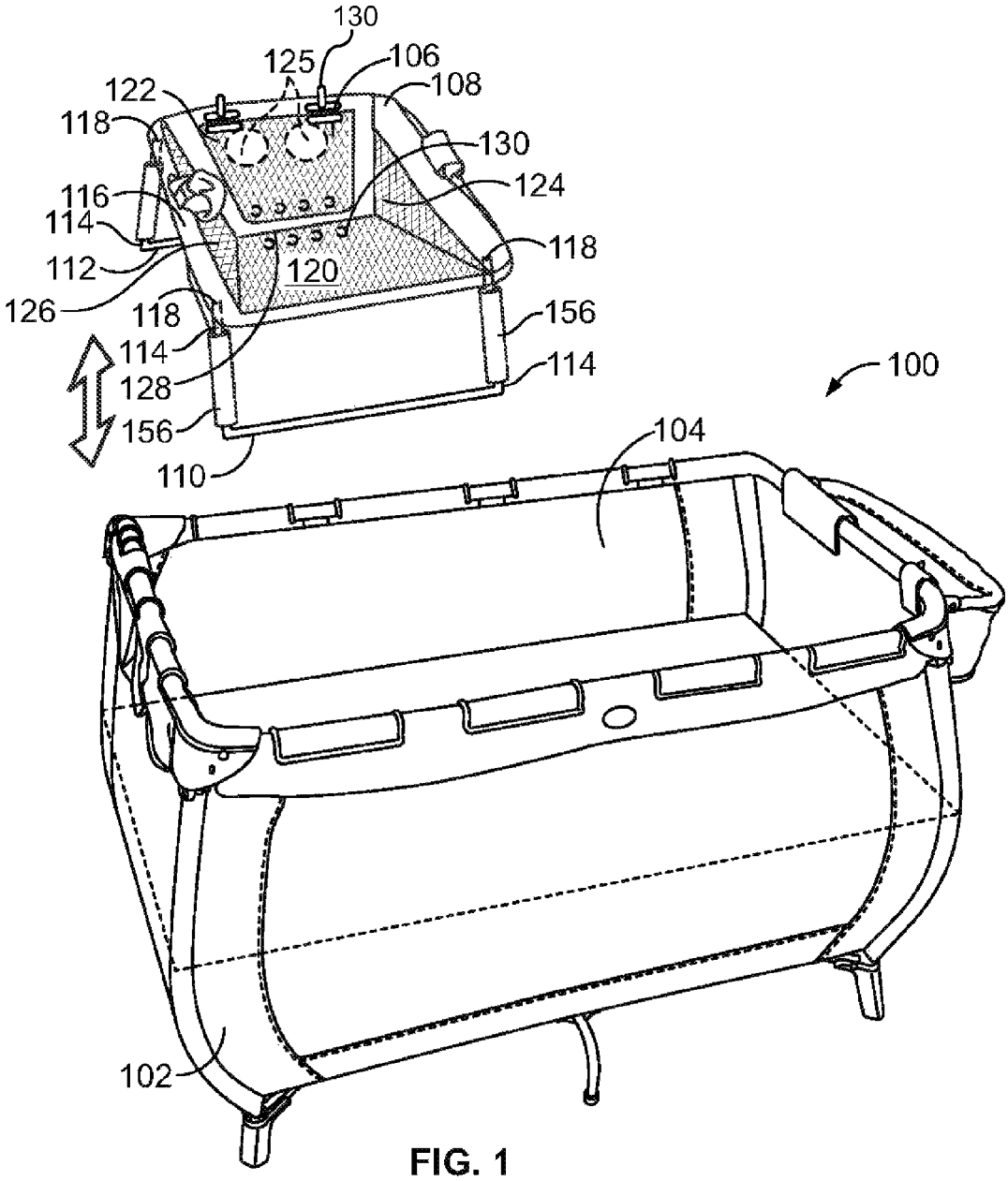
FIG. 1 is a top, front perspective view of an example bassinet seat insert constructed in accordance with the teachings of this disclosure and shown with an example playard.

FIG. 1 illustrates an example system 100 that includes a playard 102, a bassinet 104 and a seat insert 106. The example seat insert 106 of FIG. 1 is structured to be removably coupled to and/or set in either or both the playard 102 and/or the bassinet 104. For example, the example seat insert 106 may be suspended from the upper rail or frame of the example playard 102. The example seat insert 106 is also structured to be used separately from the playard 102 and/or the bassinet 104 and can be supported on an alternative surface such as, for example, a floor, the ground, etc.

The example seat insert 106 of FIG. 1 includes a frame 108 having at least two feet 110, 112. In the example shown in FIG. 1, the feet 110, 112 are lower portions of u-shaped frames. The example u-shaped frames of FIG. 1 include side legs 114 of FIG. 1 that are coupled to an upper seat insert frame 116. In other examples, other numbers of legs and/or feet such as, for example, one, two, three, four, etc. are employed. In the illustrated example of FIG. 1, the legs 114 are pivotably coupled to the upper seat insert frame 116 via pivot joints 118 so that the legs 114 and feet 110, 112 can fold from an open, in-use position (FIG. 1) to a collapsed, storage position for transportation or storage. In other examples, the feet 110, 112 and legs 114 are non-movably, slidably or telescopically coupled to the upper seat insert frame 116 and/or coupled, pivotally, non-movably, slidably or telescopically to a lower seat insert frame and/or to other components of the example seat insert 106. Also, rather than running side-to-side as in the example of FIG. 1, in some examples, the feet run longitudinally along the length of the seat insert (e.g., from the legs or feet of a child occupying the seat insert to the head of that child).

The example seat insert 106 of FIG. 1 also includes a seat back or first base panel 120, a seat bottom or second base panel 122 and two side panels 124, 126. The first base panel 120 and the second base panel 122 are joined such that their upper surfaces are positioned at an obtuse angle (e.g., an angle greater than 90° and less than 180°) when viewed from a side and mounted to the seat insert frame 108. In some examples, the first base panel 120 and the second base panel 122 are integrally formed such as, for example, by one piece of fabric or plastic. As used here, the term "panel" includes single pieces of material and/or multiple pieces of material (e.g., two, three, etc.) coupled together. In some examples, as detailed below, the base panels 120, 122 are made of soft goods, such as fabric portions, that are sewn together at a seam 128.

As shown in FIG. 1, the example first base panel 120 and the example second base panel 122 are disposed at intersecting angles (e.g., in intersecting inclined planes). The first base panel 120 is a different length than the second base panel 122, such that the first base panel 120 (e.g., as measured from the frame 116 to the seam 128) is longer than the second base panel 122 (e.g., as measured from the seam 128 to the frame 116) so that when an infant/child is placed in the seat insert 106, the infant/child is positioned (e.g., seated or lying) in an inclined (e.g., semi-upright) position with the child's bottom near or at the seam 128 (e.g., the lowest portion of the seat insert 106). In the illustrated example, the seam 128 is closer to the foot end of the seat insert 106 to allow the child to recline in an upright or semi-upright position. In some examples, the panels 120, 122 engage at a point approximately 9.0-9.5 inches (22.86-24.13 centimeters) below the top of the panel 120 (e.g., vertical depth)). The degree of incline is dependent on the relative lengths of the base panels 120, 122 with respect to each other.

In some examples, the base panels 120, 122 are permanently fixed to one another and, therefore, the seam 128 is in a fixed location. However, in other examples, the base panels 120, 122 may be movable with respect to one another. That is, the location at which the first base panel 120 is joined to the second base panel 122 may be adjustable, and/or the relative lengths of the base panels 120, 122 (e.g., from the seam 128 to their connecting point to the frame 116) may be adjusted. Such arrangements make the angle of recline of an infant adjustable. In other examples, the first base panel 120 and the second base panel 122 are fixed with respect to one another, and the angle of recline is adjustable at a top of the first base panel 120 and/or by folding one or both base panels over itself or over the other base panel. In such examples, the first base panel 120 includes mechanical fasteners 130 such as snaps or hook and loop fasteners (e.g., near the top of the first base panel 120) that can be fastened or unfastened in different orientations and/or with different components to change the effective length of the first base panel and, thus, change the angle of recline. For example, if such fasteners 130 are released, the first base panel 120 may be dropped down (i.e., lengthened relative to the interior of the frame) to produce a lower angle of recline. The fasteners 130 may be positioned on either panel 120, 122 and/or both depending on whether it is desirable to adjust the incline by adjusting a length of panel 120 (e.g., by folding a portion of panel 120 on itself), adjusting the length of panel 122 (e.g., by folding a portion of panel 122 on itself), and/or adjusting the position of the seam (e.g., by folding a portion of a panel 120, 122 over the other panel 120, 122). The fasteners 130 may create/release a fold at any desired position of the panels 120, 122 (e.g., at a point where the panels connect to the frame 116, near the seam and/or at any intermediate position between the point at which the panel connects to the frame 116 and the seam).

An example manner of providing adjustability is to join the panels 120, 122 to one another with releasable fasteners 130 positioned at different locations on the panels 120, 122. In some examples, the base panels 120, 122 are adjustable with respect to one another (e.g., by adjusting a degree of overlap between the panels. The releasable fasteners 130 of such examples may include zippers, straps, snaps, loop and hook fasteners, tack glue, or other fasteners coupled to, for example, either or both the base panels 120, 122 (e.g., the rear sides of the panels 120, 122).

Figure 2C:
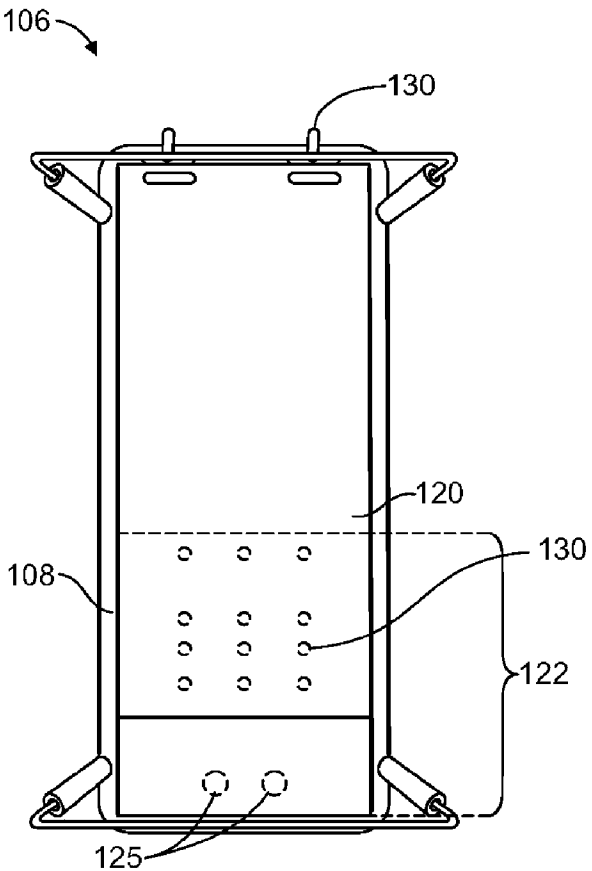
FIGS. 2A-2C are bottom views of the example seat insert of FIG. 1.
Figure 2B:
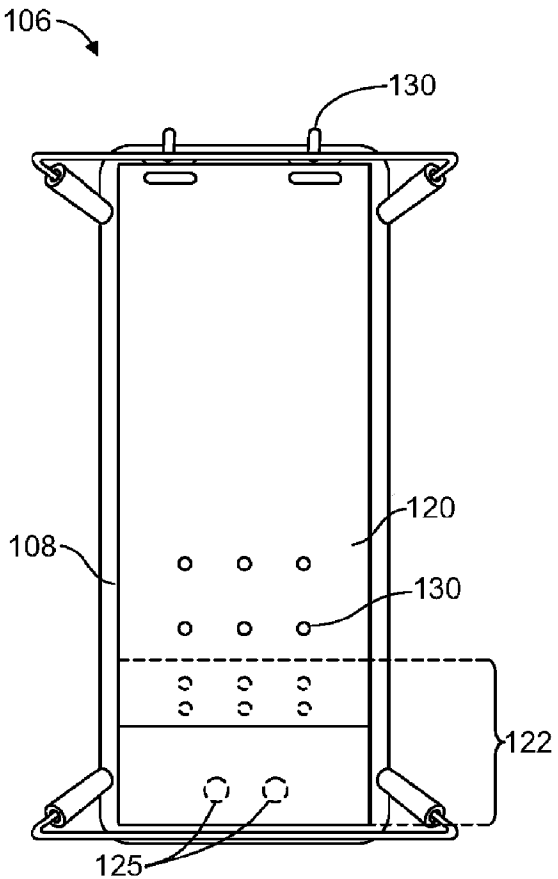
Figure 2A:
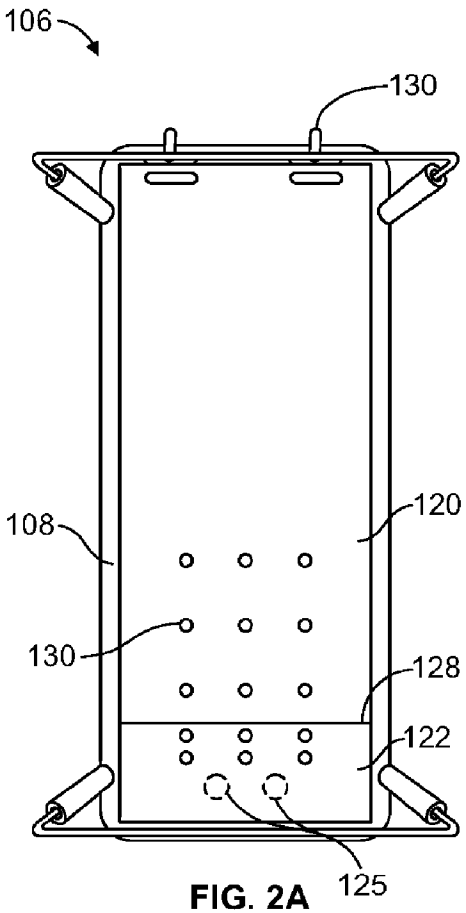

FIGS. 2A-2C are bottom views of the example seat insert 106 of FIG. 1. In the examples illustrated in FIGS. 2A-2C, the first base panel 120 includes a plurality of male snap connectors, and the second base panel 122 includes a plurality of female snap connectors. To lower the angle of inclination of the first base panel 120, the male connectors on the first base panel 120 may be detached from a current set of female connectors on the second base panel 122 (FIG. 2B) and connected to a second set of female connectors that are located closer to the foot end of the second panel 122 (FIG. 2C). To increase the angle of inclination of the first base panel 120, the male connectors of the first base panel 120 may be detached from a current set of female connectors on the second base panel 122 (FIG. 2C) and connected to a second set of female connectors that are located closer to the seam 128 (FIG. 2B). In any of these examples, the panels 120, 122 may be permanently joined to one another (e.g., integrally formed) so that these fasteners are used to adjust a degree of folding or overlapping between the panels 120, 122, but their release will not cause the panels to completely separate. Alternatively, the panels 120, 122 may not be permanently attached, but instead may be releasably attached by the fasteners. A back-up (e.g., secondary) fastener such as shock cords, ties, etc. may be used for additional safety (e.g., to prevent incidental separation of the panels 120, 122 when a child occupies the seat insert 106) in case of separable panels 120, 122.

In the example of FIG. 1, the first base panel 120 forms a back support to support an infant, baby or child's head and back. The second base panel 122 forms a leg support to support the infant, baby or child's legs. In some examples, the second base panel 122 includes openings 125 for the infant/child's legs (shown in phantom lines in FIG. 1). Also, in some examples, the base panels 120, 122 include insertable stiffening structures such as, for example, a back board and/or floorboard to provide rigidity to the seat insert 106. Such stiffening structures may be implemented by wood or cardboard secured to and/or within the panels 120, 122

The example seat insert 106 of FIG. 1 also includes, as described above, the first side panel 124 and the second side panel 126. In the illustrated example, the side panels 124, 126 are disposed on opposite sides of the base panels 120, 122 and run substantially parallel to each other. In other examples, the side panels 124, 126 run at angles with respect to each other and form a v-shaped profile or other profile with the panels 120, 122 (e.g., when viewed from the foot of the seat insert 106). The side panels 124, 126 may be a solid material or formed with meshing or other ventilation structure. In some examples, the side panels 124, 126 are integrally formed with one or more of the base panels 120, 122. As detailed below, the side panels 124, 126 may be soft goods that are sewn or otherwise mechanically and/or chemically coupled (e.g. glued) to the base panels 120, 124.

In the example of FIG. 1, the base panels 120, 122 and the side panels 124, 126 are made of a soft goods material and/or flexible support liners such as, for example, tailored soft goods, a fabric, plastic, a mesh, or any other flexible and/or breathable material or combination thereof. The panels 120, 122, 124, 126 of the illustrated example are washable and may easily be rolled, folded, crumpled or otherwise compressed for transportation and/or storage. In some examples, there are stiffening boards (e.g., a masonite board) or molded inserts inserted in the base panels 120, 122 to provide structure and support. In some examples, such boards are removably inserted into their respective panels 120, 122. Removably inserted boards may be removed prior to washing or storage. In other examples, the boards are permanently mounted within their respective panels. In some examples, the soft goods are assembled to the frame (for example in a factory) and cannot be removed.

Figure 3:
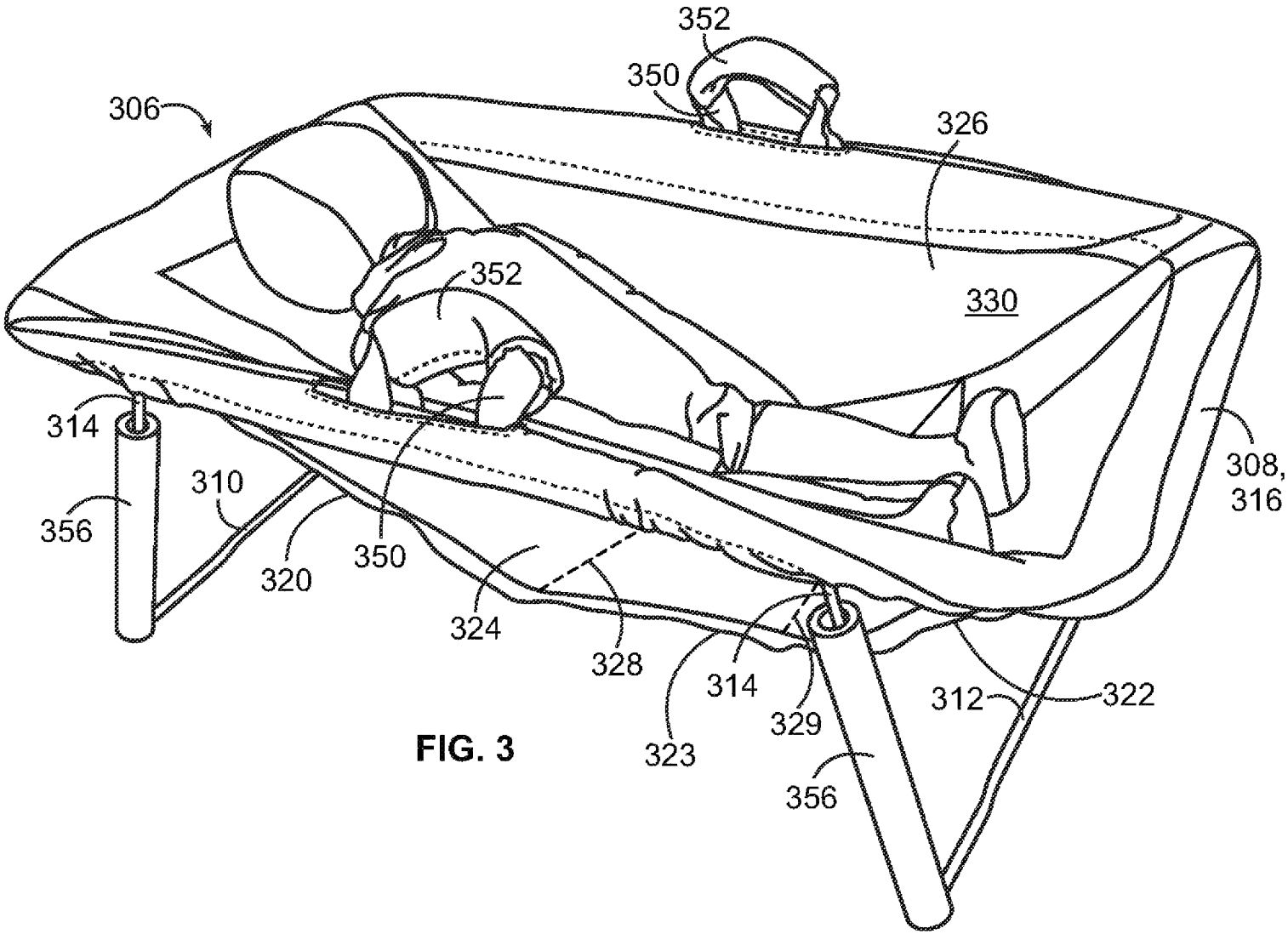
FIG. 3 is a perspective view of another example seat insert constructed in accordance with the teachings of this disclosure.
Figure 4:
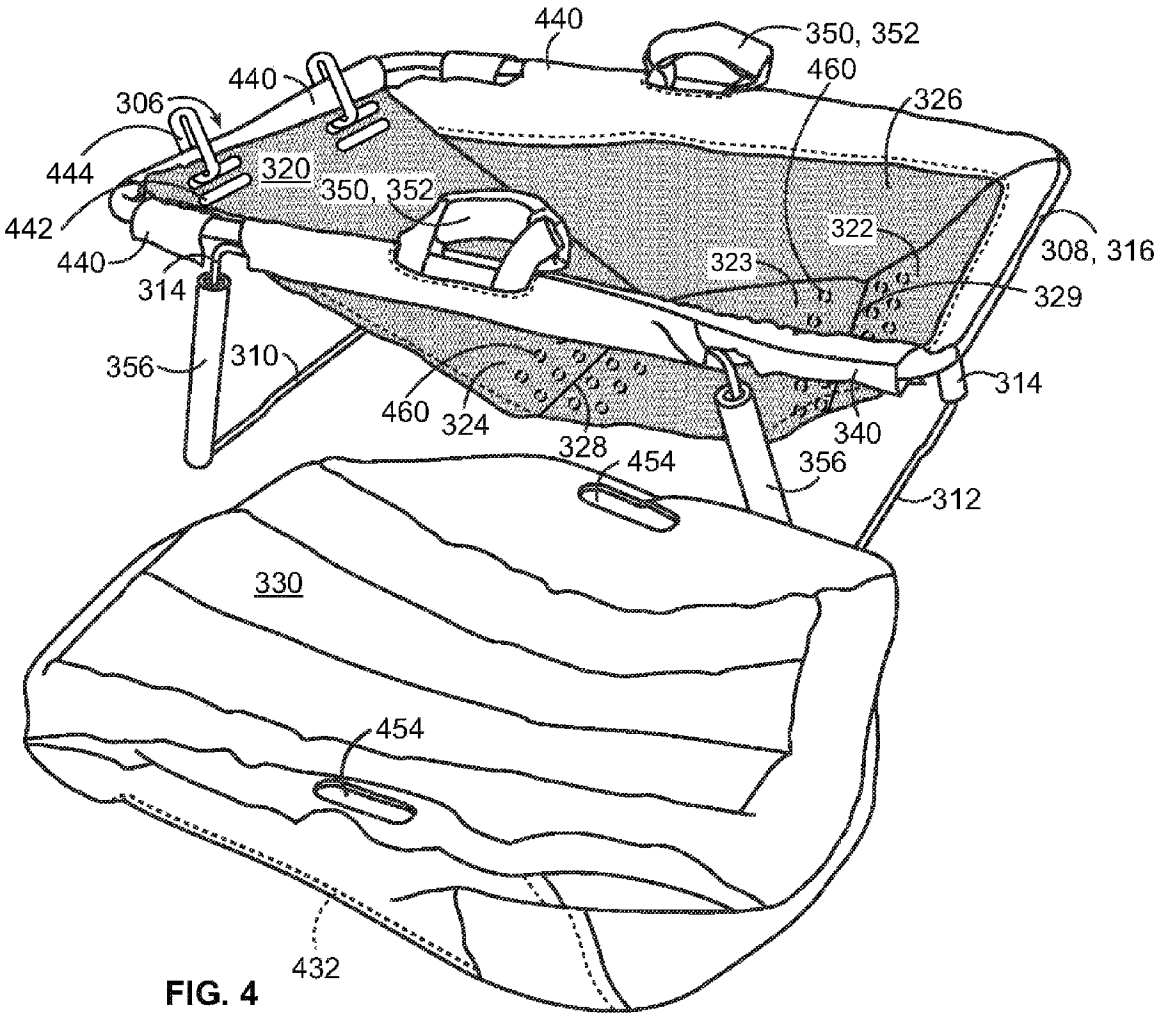
FIG. 4 is a perspective view of the example seat insert of FIG. 3 with an example seat cover removed.

FIGS. 3 and 4 are side views of another example seat insert 306 having a third base panel 323. In the example of FIG. 3, the seat insert 306 includes a seat cover 330, which is disposed over the base panels 320, 322, 323 and side panels 324, 326. The seat cover 330 may be removed (FIG. 4) and, for example, placed in a washer and/or stored. In such examples, the seat cover 330 supplements features of the underlying seat insert 306. For example, the seat cover 330 includes padded surfaces. In some examples, the seat covers include one or more breathable mesh sides. In addition, some examples include a pillow, which may be coupled to the seat cover 330. A harness may also be coupled to the seat cover 330, and/or the seat cover 330 may include a slot through which a harness that is coupled to the underlying seat insert 306 extends.

In the example shown in FIG. 4, the seat cover 330 is removed. The seat cover 330 of the illustrated example includes one or more elastic bands 432 that are sewn into or otherwise mounted to the seat cover 330. The bands 432 secure the cover 330 to the seat insert 306. The elastic bands 432 shape the fabric of the seat cover 330 into pockets that couple around portions of the example seat insert 306. In some examples, additional pockets are formed by webbing or sewing the material of the seat cover 330 to form the pocket. In this example, the elastic bands 432 couple around the seat insert upper frame 316. In some examples, the elastic bands 432 are disposed at the corners of the seat cover 330, at two or more sides, around the entire perimeter and/or otherwise distributed about the periphery of the seat cover 330. Furthermore, while elastic bands are shown in the example illustrated in FIGS. 3 and 4, some examples include other coupling mechanisms to couple the seat cover 330 to the seat insert 306 such as, for example, clips, hook and loop fasteners, snaps, straps, ties or any other suitable fasteners or a combination of such suitable fasteners.

In the example of FIG. 4, the base panels 320, 322 and side panels 324, 326 are coupled to the seat insert upper frame 316 via one or more sleeves 440. In some examples, the sleeves 440 include fabric that is sewn to form tunnels into which portions of the seat insert upper frame 316 are threaded. In some examples, the sleeves 440 include snaps that snap around the seat insert upper frame 316. In some examples, the base panels 320, 322 are coupled to straps that include loop and hook (i.e., Velcro®) fasteners. Such straps may wrap around the seat insert upper frame 316 and be removably couplable to themselves via the hook and loop fasteners. In yet other examples, the base panels 320, 322, may be coupled to straps that tie around the seat insert upper frame 316. Other suitable removable mechanical fasteners (e.g., zippers, rivets, etc.) may additionally or alternatively be used.

Furthermore, in some examples, the panels 320, 322, 324, 326 are permanently coupled to the seat insert frame 308. For example, the panels 320, 322, 324, 326 may include flaps that are sewn into the above-described sleeves and the frame 308.

In some examples, the panels 320, 322, 324, 326 are coupled to the seat insert frame 308 via other suitable mechanical and/or chemical fasteners. For example, the first base panel 320 may be sewn and/or glued to a first connector via a first seam or bond. Likewise, the second base panel 322 may be sewn and/or glued to a second connector via a second seam or bond. In such examples, the seams may be on the inner circumference of the connectors. However, the seams may additionally or alternatively be disposed on the outer circumference of the respective connectors. In some such examples, removable fasteners may be used in addition to these permanent fasteners, and the connectors may then be coupled to the seat insert frame 308.

In some examples, the panels 320, 322, 324, 326 may be coupled to the seat insert frame via the clips, straps and/or other fasteners described in U.S. patent application Ser. No. 12/769,417, which was filed on Apr. 28, 2010 and titled "Seat Inserts and Methods of Manufacture" and is hereby incorporated by reference in its entirety.

Some alternative example fasteners include ones in which the positions of the base panels 320, 322, 323 are alterable. For example, one or more of the first base panel 320 and the second base panel 322 may include a plurality of slits 442 and have straps 444 coupled thereto. The straps 444 of some such examples wrap around the frame 308 and through one of the plurality of slits 442 and then couple to another portion of the strap 444 (e.g., with loop and hook fasteners, the loop side wraps around and couples to the hook side). The plurality of slits 442 enables a user to thread the straps 444 through different slits 442 to change the effective length of the respective base panel 320, 322 and, with it, the angle of inclination of the respective base panels 320, 322, 323. Other fastener(s) including, for example, snap(s), button(s), hook(s), tie(s), and/or other suitable structure(s), may be used additionally or alternatively to the structures described herein.

The example seat insert 306 also includes a plurality of handles 350 as shown in FIGS. 3 and 4. The handles 350 may be used to move the seat insert 306 from one place to another. The examples handles 350 shown in FIGS. 3 and 4 are attached to longitudinal side rails of the seat insert upper frame 316 that are disposed to the left and right of a child occupant. Some examples include, additionally or alternatively, handles attached to lateral side rails of the seat insert upper frame 316 that are disposed at the head and feet of a child occupant. In the illustrated example, the handles 350 are reinforced strips of fabric. However, the handles may be any suitable material such as, for example, elastic bands, plastic strips of material, and/or injection molded plastic, etc. In addition, the handles 350 in the illustrated example include grip portions 352 for the comfort of a person carrying the seat insert 306. Furthermore, as shown in FIG. 4, the seat cover 330 includes apertures 454 to enable the handles 350 to pass therethrough when the seat cover 330 is assembled over the seat insert 306 (FIG. 3).

In the example shown in FIGS. 1-4, one or more of the legs 114, 314 include leg covers 156, 356. In the illustrated example, the leg covers 156, 356 are foam pads, each of which includes a central aperture into which a leg 114, 314 is disposed. The leg covers 156, 356 protect a user from pinching a finger when the legs 114, 314 are moved between the collapsed (FIG. 5) and the extended (FIG. 3) position. In addition, the leg covers 156, 356 buffer the legs from a child occupying an area next to the seat insert 106, 306.

In some examples, one or more of the legs 114, 314 include one or more rollers such as, for example, wheels or casters to facilitate movement of the seat insert 106, 306 across a surface such as, for example, a floor. The legs 114, 314 that include rollers may also include a locking mechanism that may be activated to prevent rotation of the rollers (e.g., the rollers are retractable or lockable). Individual locking mechanisms can be included for each roller or a single locking mechanism may lock or unlock all the rollers simultaneously. In some examples, other ones of the legs 114, 314 include feet for stability or anti-skid functionality.

Also, the feet 110, 112, 310, 312 shown in FIGS. 1-4 are the bottom portion of u-shaped rails. These bottom portions include a central portion that has a linear configuration to enable the seat insert 106, 306 to rest without rocking on an even surface. In some examples, the legs 114, 314 are elongated rods that end in feet, but which do not connect to other legs. In such examples, the individual legs (e.g., four) support the seat insert 106, 306 and stabilize the seat insert 106, 306 to rest without rocking on an even surface. In still other examples, the legs include feet that have a curved profile to enable the seat insert 106, 306 to rock on a surface. In some such examples, curved feet extend laterally across the seat insert 106, 306 to enable the seat insert 106, 306 to rock in a side-to-side motion. In other examples, curved feet that extend longitudinally along the seat insert 106, 306 enable the seat insert 106, 306 to rock in a front-to-back motion. Some example seat inserts also include a locking mechanism to enable and disable rocking motion. In such examples, each foot may include individual locking mechanisms or a single locking mechanism may lock or unlock all or a subset of the feet simultaneously.

In some examples, one or more of the legs 114, 314 are height adjustable. For example, one or more of the legs 114, 314 may include a first portion and a second portion that telescopes and/or slides within or along the first portion. In some such examples, one of the first portion or the second portion includes a spring loaded pin (e.g., a Valco® pin) and the other one of the first portion or the second portion includes a plurality of detents or holes. Each detent or hole corresponds to a particular height relative to the floor, bottom of a bassinet or playard or other support surface. Any number of height adjustment positions may be included. In addition, the distance of travel between each height adjustment and the overall entire range of travel may be any suitable distances. To adjust the leg 114, 314 between heights, the pin is depressed against the force of a spring to disengage the detent or hole. The first portion and the second portion are then movable with respect to one another. When the desired height is reached, the pin engages the detent or hole and the seat insert is fixed in position relative to the support surface.

In some examples, the height of two legs may be adjusted while the height of the other two remains the same to change the angle of recline of the seat insert. For example, the height of the two legs at the first base panel 120, 320 may be increased or decreased while the height of the two legs at the second base panel 122, 322 may remain the same, or the height of the two legs at the first base panel 120, 320 may remain the same while the height of the two legs at the second base panel 122, 322 is increased or decreased. When the leg heights are adjusted to different heights in this manner, the angles of incline of the base panels 120, 122, 320, 322, 323 are adjusted to enable a child occupant to sit in more or less reclined positions. In some such examples, the seat insert upper frame 116, 316 includes pivot points on the longitudinal portions of the seat insert upper frame 116, 316 to enable the first and second sections to move (e.g., bend) relative to each other.

Figure 5:
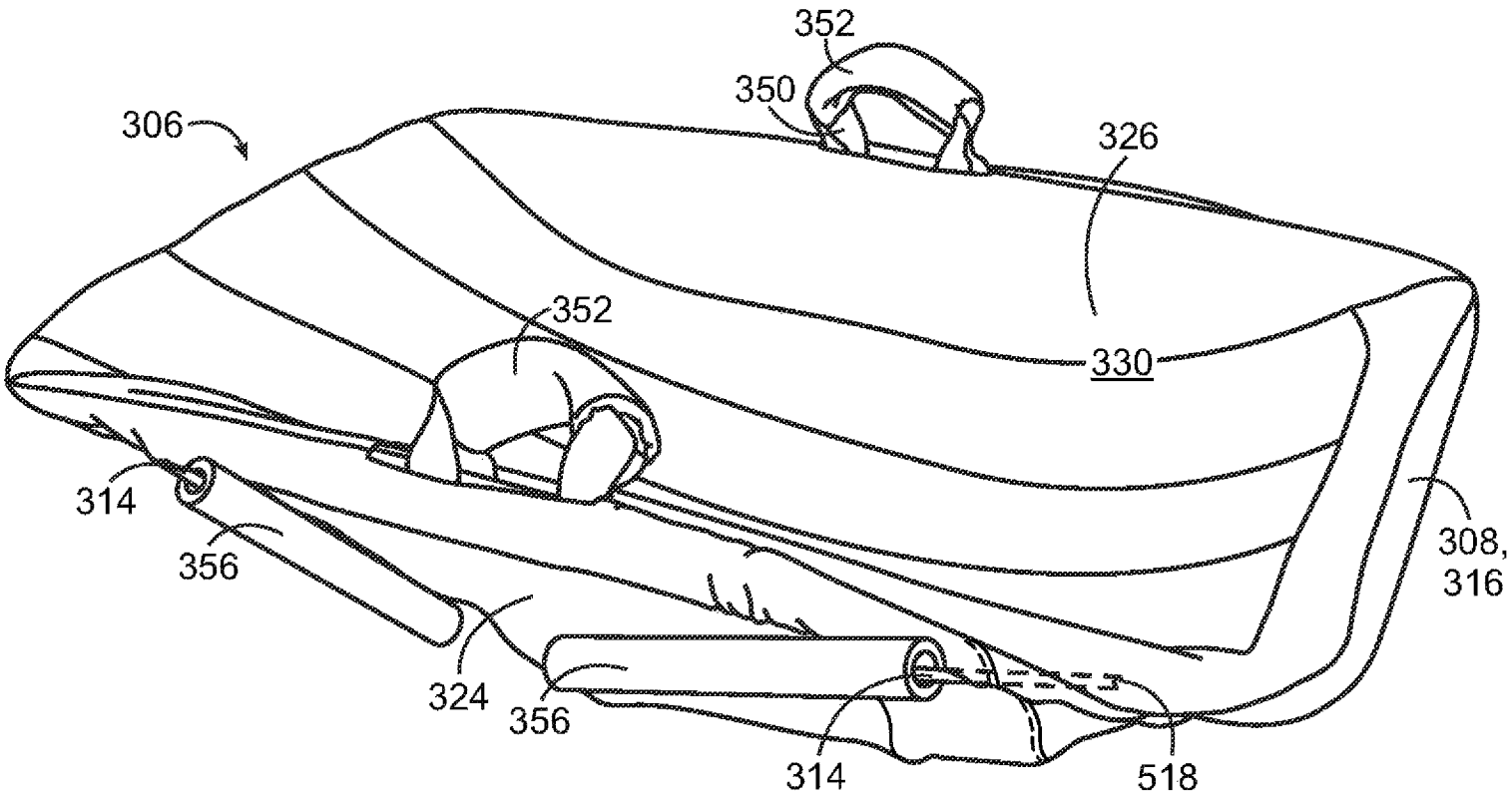
FIG. 5 is a perspective view of the example seat insert of FIG. 3 with its legs in a collapsed, storage position.

FIG. 5 illustrates the example seat insert 306 of FIGS. 3 and 4 in a collapsed, storage position. In the illustrated example, the upper seat insert frame 316 includes pivot joints 518 to enable the legs 314 and feet 310, 312 to fold from an open, in-use position (e.g., the position of FIGS. 3 and 4) to a collapsed, storage position (e.g., the position of FIG. 5).

The example seat insert 306 of FIGS. 3-5 includes a third base panel 323. The third base panel 323 has a first end and second end. The first end of the third base panel 323 is joined to one of the ends of the first base panel 320 such that their upper surfaces are positioned at an obtuse angle when viewed from a side. The second end of the third base panel 323 is joined to one of the ends of the second base panel 322 such that their upper surfaces are positioned at an obtuse angle when viewed from the side.

In some examples, the base panels 320, 322, 323 are permanently fixed to one another at the first seam 328 and a second seam 329. The base panels 320, 322, 323 may be movable with respect to one another. The locations at which the third base panel 323 is joined to the first base panel 320 and the second base panel 322 may be adjustable, and/or the relative lengths of the base panels 320, 322, 323 may be adjusted.

In some examples, the angle of recline is adjustable at a top of the first base panel 320 and/or the second base panel 322 and/or by folding one, two, or all of the base panels 320, 322, 323 over itself or over the adjacent base panel 320, 322, 323. In such examples, the first base panel 320, the second base panel 322, and/or the third base panel 323 include mechanical fasteners 460 such as snaps or hook and loop fasteners (e.g., near the top of the first base panel 320 and/or the second base panel 322 and/or near the first seam 328 and/or the second seam 329) that can be fastened or unfastened in different orientations and/or with different components to change the effective lengths of the first base panel 320, the second base panel 322, and/or the third base panel 323.

The fasteners 460 may be positioned on one or more panels 320, 322, 323 depending on whether it is desirable to adjust the incline by adjusting a length of panel 320 (e.g., by folding a portion of panel 320 on itself), adjusting the length of panel 322 (e.g., by folding a portion of panel 322 on itself), adjusting the length of panel 323 (e.g., by folding a portion of panel 323 on itself), or adjusting the position of the first seam 328 and/or the second seam 329 (e.g., by folding a portion of panel 320 and/or panel 322 over panel 323 and/or by folding a portion of panel 323 over panel 320 and/or panel 322).

An example manner of providing adjustability is to join the panels 320, 322, 323 to one another with releasable fasteners 460 positioned at different locations on the panels 320, 322, 323. In some examples, the base panels 320, 322, 323 are adjustable with respect to one another (e.g., by adjusting a degree of overlap between the panels 320, 322, 323). The releasable fasteners 460 may include zippers, straps, snaps, loop and hook fasteners, tack glue, or other fasteners coupled to, for example, one or more of the base panels 320, 322, 323. In any of these examples, the panels 320, 322, 323 may be permanently joined to one another (e.g., integrally formed) so that these fasteners 460 are used to adjust a degree of folding or overlapping between the panels 320, 322, 323. Alternatively, the panels 320, 322, 323 may not be permanently attached, but instead may be releasably attached by the fasteners 460. A back-up (e.g., secondary) fastener such as shock cords, ties, etc. may be used for additional safety (e.g., to prevent accidental separation of the panels 320, 322, 323 when a child occupies the seat insert) in case of separable panels 320, 322, 323.

As described above, the example seat insert 106, 306 may be combined with a bassinet 104 and/or a playard 102, as illustrated in FIG. 1. In the example of FIG. 1, the bassinet 104 is attached to the frame of the playard 102 by a plurality of hooks. Other example playards and/or bassinets, which may be used in this include those described in U.S. Pat. No. 5,778,465, which is entitled "Bassinet for Attachment to a Child's Playard," U.S. Pat. No. 5,867,850, which is entitled "Bassinet", and U.S. Pat. No. 7,458,114, which is entitled "Clips for Mounting Accessories to Play Yards and Methods of Operating the Same", all of which are hereby incorporated by reference in their entireties.

In some examples, removing the seat insert 106, 306 reveals the underlying bassinet 104 or other support structure (e.g., the playard 102) onto which the seat insert 106, 306 is placed or to which the seat insert 106, 306 is coupled. With the seat insert 106, 306 removed, the bassinet 104 of the illustrated example is accessible and usable for child care-taking functions. Also, in examples in which the seat insert 106, 306 only covers a portion of the bassinet 104 or playard 102, the seat insert 106, 306 and the bassinet 104 or playard 102 are accessible simultaneously without requiring the seat insert 106, 306 to be removed.

Figure 6:
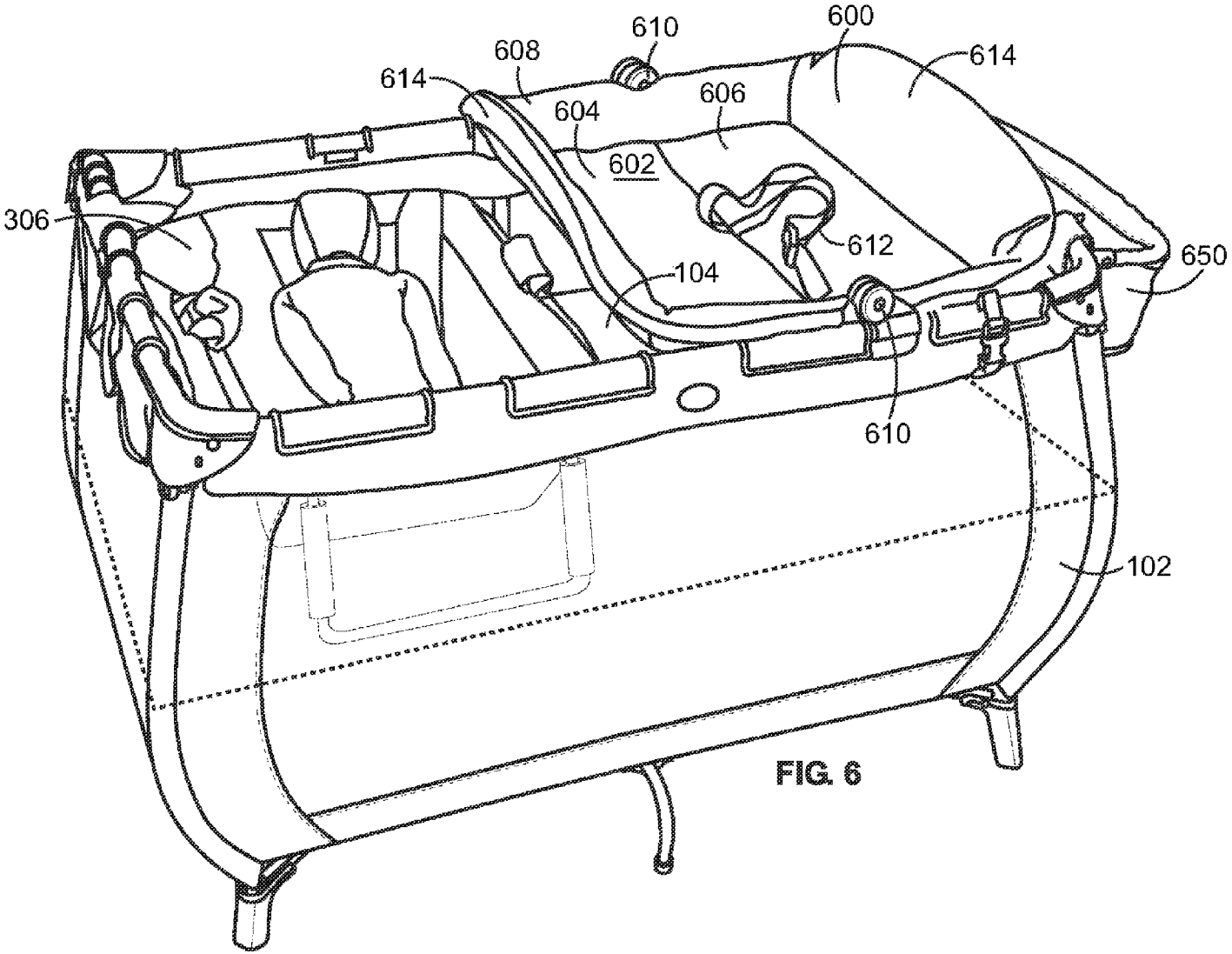
FIG. 6 is a left-front perspective view of the example seat insert of FIG. 3 shown mounted to an example playard.

In other examples, as shown in FIG. 6, the seat insert 106, 306 is usable in a side-by-side relationship with another child care-taking structure such as, for example, a changing table 600. In such examples, the seat insert 106, 306 rests on the surface of the bassinet 104. The example changing table 600 of FIG. 6 includes a bottom 602 that includes a first bottom panel 604 and a second bottom panel 606 that are covered with soft goods. The example changing table 600 also includes a top changing table rail 608 that has a pivot point 610 on two sides to enable the pivoting of the top changing table rail 608 between a closed position and the shown opened position. The changing table 600 also includes a child restraint harness 612 and enlarged sidewalls 614 to facilitate containment of a child on the changing table 600. The example of FIG. 6 also includes supplemental storage pockets or containers 650. Other example playards, bassinets, changing tables and/or storage compartments include those described in U.S. Pat. No. 5,778,465, which is entitled "Bassinet for Attachment to a Child's Playard," U.S. Pat. No. 5,867,850, which is entitled "Bassinet", U.S. Pat. No. 7,568,242, which is entitled "Play Yards and Methods of Operating the Same", and U.S. Pat. No. 7,458,114, which is entitled "Clips for Mounting Accessories to Play Yards and Methods of Operating the Same", all of which are hereby incorporated by reference in their entireties.

Figure 7:
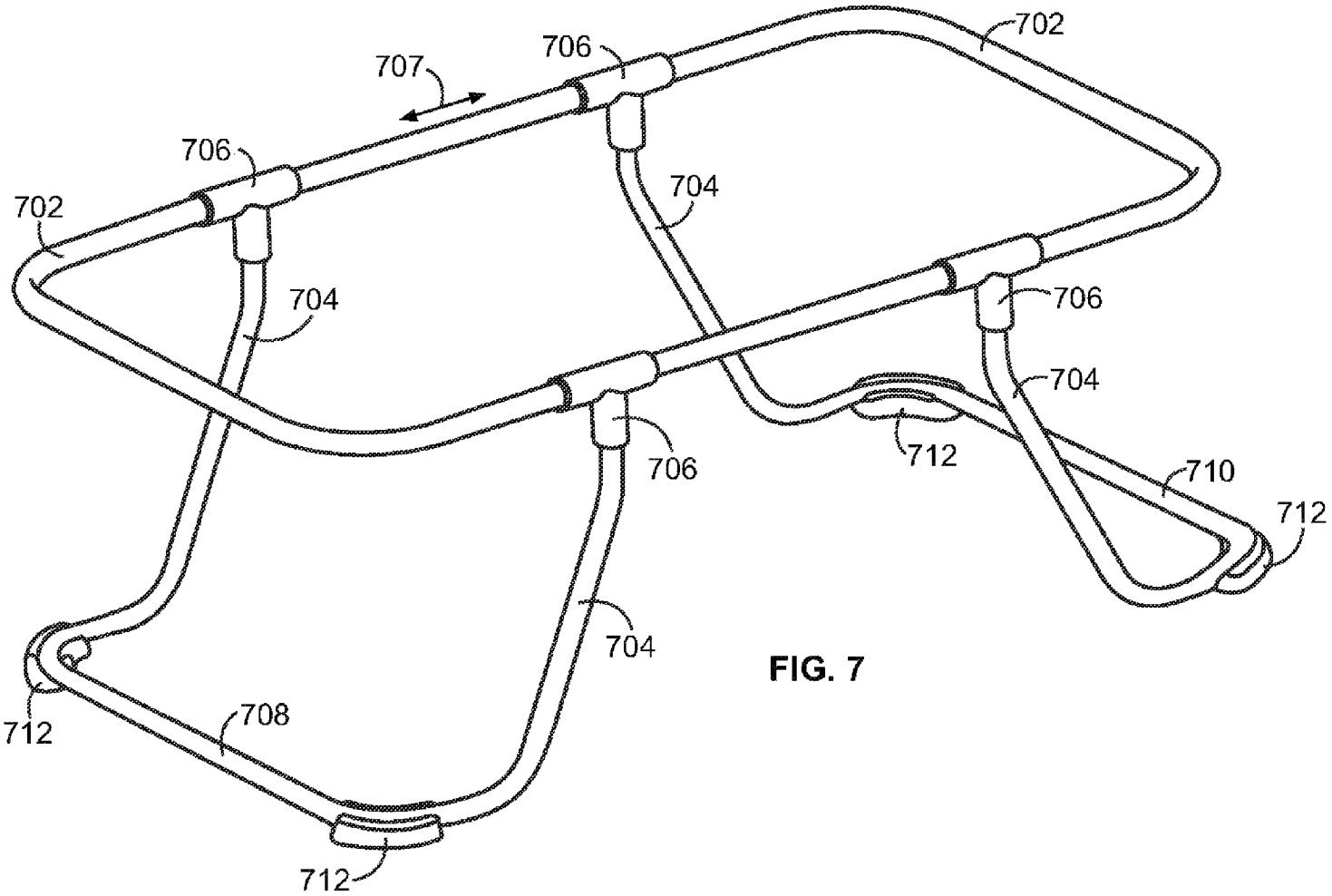
FIG. 7 a perspective view of an alternative example seat insert frame constructed in accordance with the teachings of this disclosure.

FIG. 7 shows an alternative example frame 700 for a seat insert. The example frame 700 includes an upper rail 702 and four legs 704. The legs 704 are coupled to the upper rail 702 at junctions 706. In this example, the junctions 706 are non-movable connections. In other examples, one or more of the junctions 706 may slide along the top rail 702 in the direction of the arrows 707 to change the distance between the legs 704 to increase the foot print of the seat insert 700 and/or enable a more compact frame depending on the space restrictions in the area of use. In some such examples, the junctions 706 include a spring loaded pin (e.g., a Valco® pin) and the upper rail 702 includes a plurality of detents or holes. Each detent or hole corresponds to a particular distance between the legs 704. Any number of adjustment positions may be included. In addition, the distance of travel between each adjustment and the overall range of travel may be any suitable distances. To adjust the junction 706, the pin is depressed against the force of a spring to disengage the detent or hole. The junction 706 is then movable with respect to the upper rail 702. In addition, although the legs 704 are shown with bends and angling outward, any desired shape and/or orientation may be used.

The legs 704 of FIG. 7 extend into integrally formed feet 708, 710. In other examples, the feet 708, 710 are separate components. In the example of FIG. 7, the feet 708, 710 are bottom portions that couple adjacent legs 704 to form u-shaped members. In this example, the feet 708, 710 are oriented parallel with the support surface to increase stability of an example seat insert. In addition, in the example of FIG. 7, a plurality of stabilizer grips 712 are coupled to the feet 708, 710. The stabilizer grips 712 provide traction to reduce inadvertent movement of the frame 700 along a support surface. Although two stabilizer grips 712 are shown attached to each foot 708, 710 in FIG. 7, other numbers of stabilizer grips, for example, zero, one, two, three, etc., may be employed.

Soft goods such as those shown above in connection with FIGS. 1, 2, 3 and/or 4 may be mounted on the frame 700 to form a seat insert.

Although the example frames 108, 308, 700 described above support the top perimeter of the example seat insert, in some examples, the seat insert includes a lower frame such as, for example, a rectangular or round frame suspended from the top frame 108, 308, 700 by downward projecting rails. In some such examples, adjusting lengths of the rails to skew the lower frame relative to the upper frame creates the inclined relationship between the base panels 120, 122, 320, 322, 323. In other such examples, the incline is created by the soft goods as disclosed above.

Figure 8:
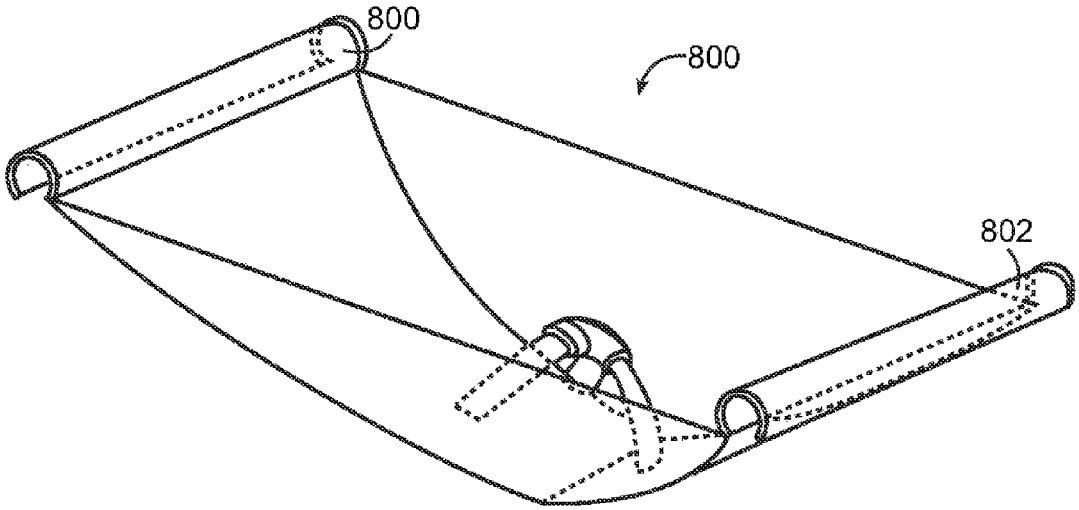
FIG. 8 is a perspective view of another example seat insert constructed in accordance with the teachings of this disclosure.

FIG. 8 illustrates an alternative example seat insert 800 that includes clips 802 to enable the example seat insert 800 to be mounted directly to a playard or bassinet frame. This example seat insert 800 does not include legs or a frame. Further details regarding the example of FIG. 8 are described in U.S. patent application Ser. No. 12/769,417, which is incorporated into this patent by reference. The various coupling mechanisms, clips, pillows, harnesses, locking mechanisms, straps, canopies, mobiles and/or other features in application Ser. No. 12/769,417 may be incorporated into and/or replace feature of the examples described herein. In addition, any of the example seat inserts disclosed above may include these clips 802 such as those shown in FIG. 8 to facilitate mounting the insert to the top of a playard and/or a bassinet. In some such examples, the legs 114, 314, 704 of the seat insert may be removed from the frame 108, 308, 700 before an example seat insert 106, 306 is attached to a playard or a bassinet via the clips 802. To this end, the legs 114, 604 of the seat insert 106, 306 may be releasably coupled to the frame 108, 308, 706, via any suitable releasable fasteners such as, for example, Valco® pins.

Figure 9:
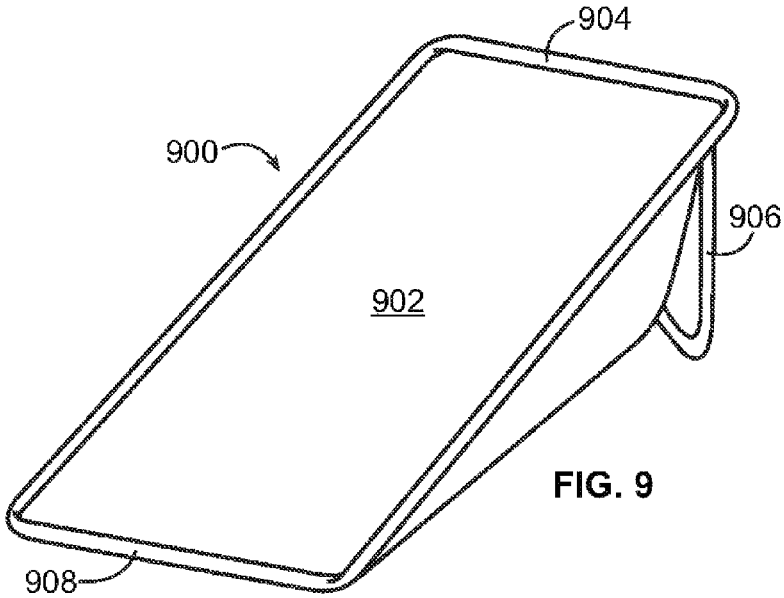
FIG. 9 is perspective view of another example seat insert constructed in accordance with the teachings of this disclosure.
Figure 10:
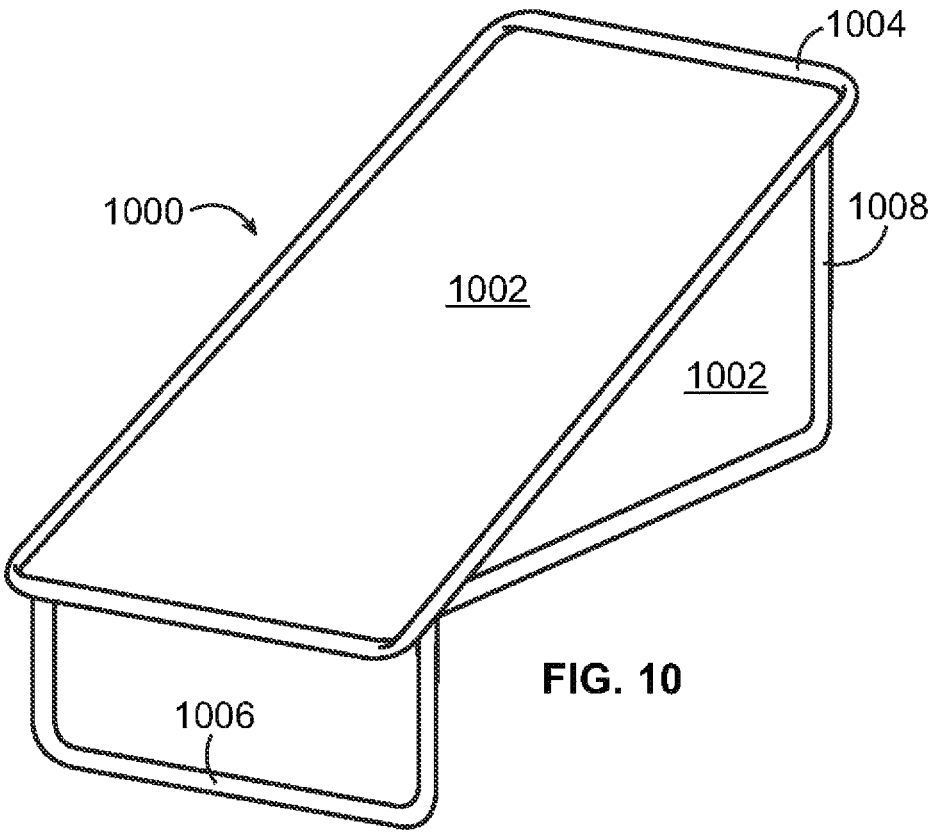
FIG. 10 is perspective view of another example seat insert constructed in accordance with the teachings of this disclosure.
Figure 11:
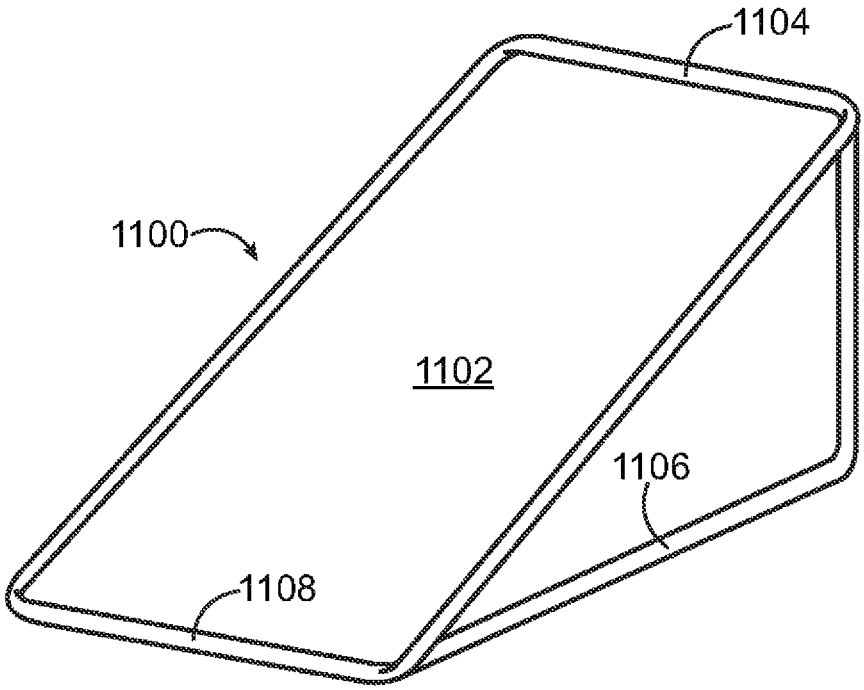
FIG. 11 is perspective view of another example seat insert constructed in accordance with the teachings of this disclosure.

Other alternative example seat inserts and frames are shown in FIGS. 9-11. Specifically, FIG. 9 shows an example seat insert 900 that includes a child support surface 902, an upper frame 904 and a single foot 906. A front portion 908 of the example frame 904 serves as a support to support the seat insert 900 on a surface such as, for example, a playard or bassinet floor or the ground, as described above. The child support surface 902 may comprise the panels 120, 122, or 320, 322, and 323 of the above examples.

FIG. 10 shows an example seat insert 1000 that includes a child support surface 1002, an upper frame 1004 and a single foot 1006. The example seat insert 1000 includes a lower frame 1008 that provides support and shape structure to the child support surface 1002. In this example, the lower frame 1008 serves as a support to support the example seat insert 1000 on a surface such as, for example, one or more of the surfaces described herein. The child support surface 1002 may comprise the panels 120, 122, or 320, 322, and 323 of the above examples.

FIG. 11 shows another example seat insert 1100 that includes a child support surface 1102, an upper frame 1104 and a lower frame 1106 that provides support and shape structure to the child support surface 1102. In this example, the lower frame 1106 and a front portion 1108 of the upper frame 1104 serve as supports to support the example seat insert 1100 on a surface such as, for example, one or more of the surfaces or rails described herein. The child support surface 1102 may comprise the panels 120, 122, or 320, 322, and 323 of the above examples.

Figure 12:
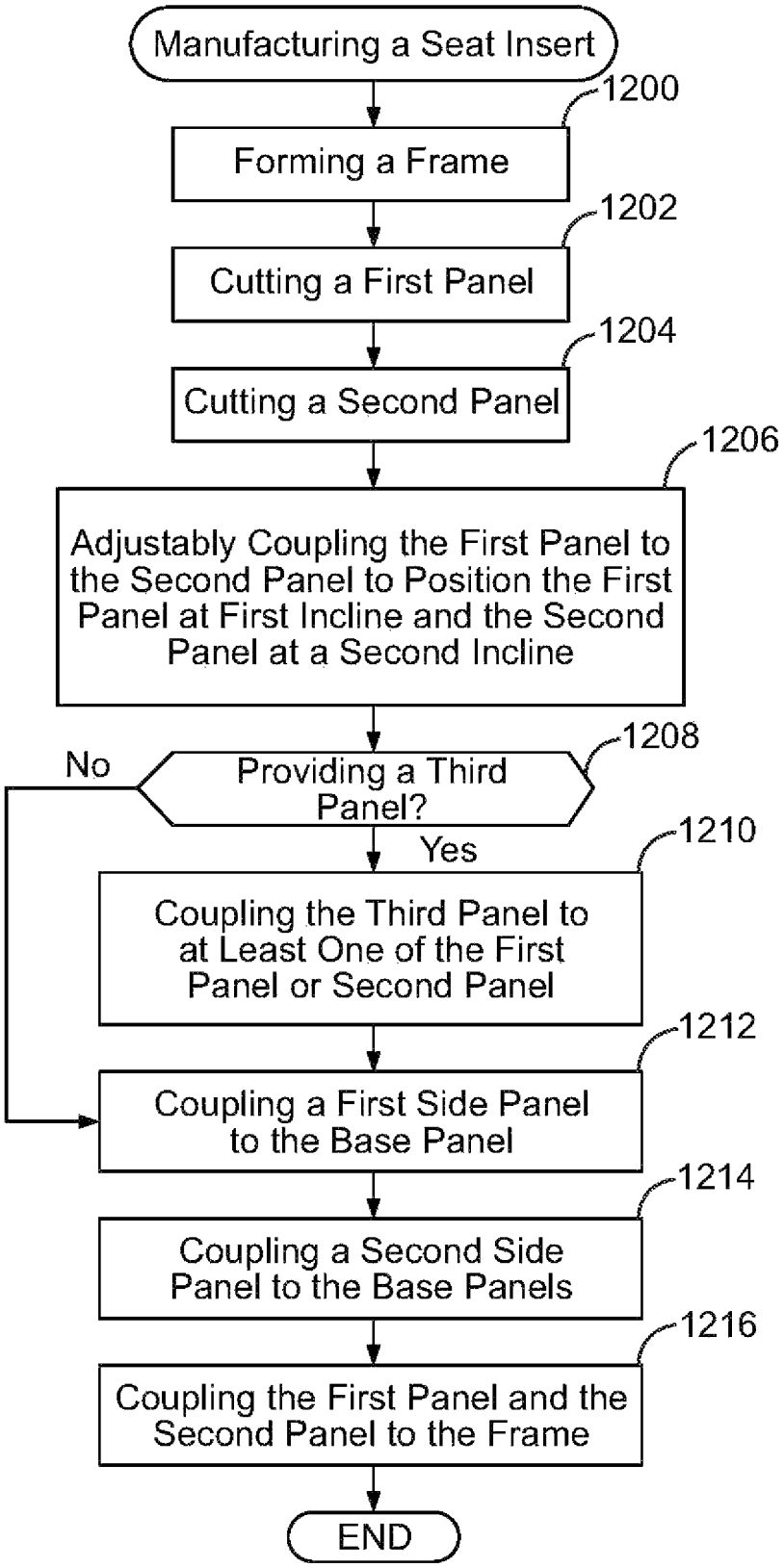
FIG. 12 is a flow chart representative of an example method of manufacturing an example seat insert in accordance with the teachings of this disclosure.

FIG. 12 is a flowchart representative of an example method 1200 of manufacturing an example seat insert such as, for example, the example seat inserts 106, 306, 800, 900, 1000, 1100 and/or frames 108, 308, 700, 904, 1004, 1104, 1106 disclosed above. Although the example method of manufacturing is described with reference to the flowchart illustrated in FIG. 12, many other methods of manufacturing the example seat inserts may alternatively be used. For example, the order of execution of the blocks may be changed and/or some of the blocks described may be changed, eliminated, or combined.

The example method of FIG. 12 includes forming a frame (block 1200). The frame may be, for example, the frame 116 and legs 114 of FIG. 1. The example method of FIG. 12 also includes cutting a first panel (block 1202) of a desired length to form, for example, the base panel 120 and cutting a second base panel (block 1204) of a desired length to form, for example, the base panel 122. In the example of FIG. 12, the first panel and the second panel are also adjustably coupled to each other (block 1206). To this end, some example methods include coupling mechanical fasteners to the first panel and the second panel to enable adjustment of the first panel relative to the second panel. The adjustable coupling of the first and second panels enables the effective lengths of the first and second panels to be adjusted so the first and second panels are positioned in a desired inclined orientation, which causes a child occupant to assume a semi-upright position.

If a third panel (e.g., base panel 323) is to be provided (block 1208), the third panel is cut to a suitable length and coupled to the first panel and/or second panel (block 1210). For example, the third panel may be coupled between the first panel (e.g., the seat back or first base panel 320) and the second panel (e.g., the seat bottom or the second base panel 322) or between the frame and one of the first base panel or the second base panel.

Subsequently, a first side panel (e.g., side panel 124) is coupled to the base panels (block 1212). A second side panel (e.g., side panel 126) is also coupled to the base panels (block 1214). The first panel and the second panel to the frame are then coupled to the frame (block 1216).

The orientation of the base panels of the example seat inserts disclosed above provides an inclined sleep/resting surface for an infant occupying the seat inserts, which elevates the child's head relative to his/her feet. The inclined surface may help ease symptoms of reflux or congestion and/or otherwise facilitate digestive and/or respiratory functions in some situations.

From the foregoing, persons of ordinary skill in the art will appreciate that the seat insert(s) and methods of assembling and/or manufacturing. The same have been disclosed. Although substantially rectangular frames 108, 308, 700, 904, 1004, 1104, 1106 are illustrated herein, frames of other shapes may be additionally or alternatively used such as, for example, oval. The teachings of this disclosure are applicable to any type of child care products such as bouncers, swing seats, cribs, high chairs, stand-alone bassinets, rocking bassinets, stand-alone changing tables, etc. In addition, as noted above, the example seat inserts disclosed herein may be used alone and/or with other child care products.

Although certain example methods and apparatus have been described herein, the scope of coverage of this patent is not limited thereto. On the contrary, this patent covers all methods, apparatus and articles of manufacture fairly falling within the scope of the claims of this patent either literally or under the doctrine of equivalents.

What is claimed is:

1. A seat insert comprising:

a frame to support the seat insert on a first surface outside of a child care-taking structure, the frame transportable from the first surface to a second surface of the child caretaking structure, the frame to support the seat insert on the second surface;

a first base panel coupled to the frame; and a second base panel coupled to the frame, the second base panel joined to the first base panel, the first base panel positioned at a first incline and the second base panel positioned at a second incline to provide an inclined support for a child, wherein a relative length of at least one of the first base panel or the second base panel is adjustable to adjust angles of inclination of the first base panel and the second base panel.

2. A seat insert as defined in claim 1, wherein the first base panel and the second base panel are integrally formed.

3. A seat insert as defined in claim 1, wherein the second base panel includes at least one aperture for an occupant's legs.

4. A seat insert as defined in claim 1, further comprising a first side panel and a second side panel disposed on opposite sides of the first and second base panels, each of the first side panel and the second side panel coupled to the first base panel and the second base panel.

5. A seat insert as defined in claim 4, wherein the first and second side panels form a v-shaped profile with at least one of the first or second base panels.

6. A seat insert as defined in claim 1, further comprising a cover disposed over the first and second base panels.

7. The seat insert as defined in claim 1, further comprising a foot slidably coupled to the frame to increase or decrease a footprint of the frame.

8. The seat insert as defined in claim 1, wherein the seat insert frame is to support the seat insert on a child care structure.

9. The seat insert as defined in claim 1, wherein at least one of the first base panel and the second base panel includes mechanical fasteners to adjust the relative length of at least one of the first base panel or the second base panel, and wherein adjusting a degree of overlap between the first base panel and the second base panel or folding a portion of at least one of the first base panel and the second base panel on itself adjusts the angles of inclination of the first base panel and the second base panel.

10. The seat insert as defined in claim 1, wherein at least one of the first base panel or the second base panel includes at least one slit and strap, each strap to wrap around the frame and through the at least one slit to adjust the effective length of at least one of the first base panel or the second base panel.

11. A seat insert, comprising:

a frame to support the seat insert on a first surface outside of a child care-taking structure or a second surface of the child care-taking structure, the frame transportable from the first surface onto the second surface and from the second surface onto the first surface;

a first base panel coupled to the frame at a first incline;

a second base panel coupled to the frame at a second incline; and a third base panel joined to at least one of the first base panel or the second base panel, a length of the third base panel being adjustable to adjust one or more of an angle of inclination of the first base panel, an angle of inclination of the second base panel, or an angle of inclination of the third base panel to provide an inclined support for a child occupant.

12. A seat insert as defined in claim 11, wherein the first base panel, the second base panel, and the third base panel are integrally formed.

13. A seat insert as defined in claim 11, wherein at least one of the first panel, the second base panel, or the third base panel includes at least one aperture for the occupant's legs.

14. A seat insert as defined in claim 11, further comprising a first side panel and a second side panel disposed on opposite sides of the first, second and third base panels, each of the first side panel and the second side panel coupled to the first base panel, the second base panel and the third base panel.

15. A seat insert as defined in claim 11, further comprising a cover disposed over the first, second, and third base panels.

16. The seat insert as defined in claim 11, wherein the seat insert frame is to support the seat insert on a child care structure.

17. The seat insert as defined in claim 11, further comprising clips to enable the seat insert to be mounted directly to a playard or bassinet frame.

18. The seat insert as defined in claim 11, wherein one or more of the angle of inclination of the first base panel, the angle of inclination of the second base panel, or the angle of inclination of the third base panel is adjustable by folding at least one of the first base panel, the second base panel, or the third base panel over itself or adjusting a degree of overlap between the third base panel and at least one of the first base panel or the second base panel.

19. A method of manufacturing a seat insert, the method comprising:

coupling a first panel to a second panel to position the first panel at a first incline and the second panel at a second incline to cause a child to assume an inclined position;

coupling the first panel to a frame; and coupling the second panel to the frame, a relative length of at least one of the first panel or the second panel being adjustable to adjust angles of inclination of the first panel and the second panel, and the frame being structured to support the seat insert on a first surface outside of a child care-taking structure, the frame being transportable from the first surface to a second surface of the child care-taking structure, the frame to support the seat insert on the second surface.

20. A method as defined in claim 19, further comprising:

providing a third panel; and coupling the third panel to at least one of the first panel or the second panel.

21. A method as defined in claim 19, further comprising coupling mechanical fasteners to the first panel and the second panel to enable adjustment of at least one of the first and second panels.

22. A method as defined in claim 19, further comprising:

coupling a first side panel to the first panel and the second panel; and coupling a second side panel to the first panel and the second panel.

* * * * *